US005542378A

United States Patent [19]

Kubiak et al.

[11] Patent Number: 5,542,378

[45] Date of Patent: Aug. 6, 1996

[54] WATERWALL TUBE BLOCK DESIGN

[75] Inventors: Stephen M. Kubiak, Shrewsbury, Mass.; Tatsuo Nishida, Chiba, Japan

[73] Assignee: Saint-Gobain/Norton Industrial Ceramics Corp., Worcester, Mass.

[21] Appl. No.: 252,707

[22] Filed: Jun. 2, 1994

[51] Int. Cl.[6] ..... F22B 37/20

[52] U.S. Cl. ..... 122/235.12; 122/510; 122/511; 165/162

[58] Field of Search ..... 122/235.12, 510, 122/511; 165/162

[56] References Cited

U.S. PATENT DOCUMENTS 3,838,665 10/1974 Astrom ..... 122/235.12
3,844,254 10/1974 Astrom ..... 122/235.12
5,154,139 10/1992 Johnson ..... 122/235.12
5,423,294 6/1995 Cole et al. ..... 122/512

*Primary Examiner*—Tony M. Argenbright
*Attorney, Agent, or Firm*—Thomas M. DiMauron

[57] ABSTRACT

A waterwall heat transfer system has a tube block secured to a tube assembly. The tube assembly includes a plurality of parallel tubes connected together by a membrane. The tube block has a base section and a plurality of spaced ridges extending upward from the base section, the upper surface of at least one of the spaced ridges defining a generally horizontal surface. The ridges are spaced to define channels therebetween with the height of at least one of the ridges selected to provide a seat for the membrane of the assembly.

11 Claims, 3 Drawing Sheets

WATERWALL TUBE BLOCK DESIGN

TECHNICAL FIELD

The present invention is directed to refractory tube blocks which protect metallic waterwall tubes from hot and highly corrosive furnace gases, while at the same time maintaining good heat conductivity.

BACKGROUND OF THE INVENTION

Municipal solid waste (MSW) facilities incinerate trash and garbage in furnaces at temperatures of up to about 2500 degrees F. In order to recover the valuable energy produced in these MSW plants, water is passed through metallic waterwall tubes adjacent to the furnace and converted to steam by the high temperatures. A conventional waterwall boiler tube assembly comprising metallic tubes T connected by membrane M is provided in FIG. 1. The steam produced in the tube assembly is then used to power a turbine-driven electrical generator. However, the MSW plant also produces gaseous products which, if allowed to contact the metal tubes, would chemically attack those tubes. To prevent direct attack of the tubes by the gaseous products and still allow the tubes to be sufficiently heated, a protective refractory lining is placed between the waterwall tubes and the furnace fireside.

Although these refractory linings help to minimize attack on the metallic tubes, their use inhibits the heat flow from the furnace fireside to the waterwall tubes. Maximum heat flow is critical to achieving boiler efficiency. If the refractory lining has insufficient heat transfer the fireside surface of the refractory becomes hotter than designed. As the temperature increases, ash from the fuel being burned will cling to the surface and form an insulating layer. Once this phenomenon begins, the layer gets increasingly thick until heat transfer becomes extremely poor. The "flue gas" above the combustion zone then increases in velocity and temperature, often above the design limits, and causes corrosion/erosion problems downstream in the furnace. In addition, the layer of ash/slag buildup may eventually break off as it grows and cause major damage to the stoker grate bar area of combustion zone. It is well known that the heat transfer efficiency of a refractory lining is inversely related to its thickness. For example, a refractory having a 2 inch thickness has only 50% of the heat transfer efficiency of the same barrier having a 1 inch depth. Accordingly, the industry has demanded to use refractory lining materials which minimize refractory lining thickness and favor refractory linings as thin as possible.

The metallic waterwall tubes and refractory linings are often installed by hanging them from the ceiling of the building housing the furnace. Since these waterwall tubes and refractory lining can often run about 100 feet tall, the weight of these hanging waterwall tubes and refractory linings presents a safety issue. Accordingly, safety considerations provide further motivation for making refractory barriers as thin as possible.

Although the industry has recognized the need for thin refractory barriers, it also recognizes it cannot reduce the depth of these barriers without usually degrading performance. In particular, it has been found that reducing the depth too much (i.e., down to about ½ inch) weakens the strength of the barrier to the point where it cannot withstand the stresses produced by the tubes at high temperatures. Accordingly, the industry routinely uses barriers whose depths are at least about 0.875 to 1.00 inches in minimum cross section.

The MSW industry has developed different types of refractory structures in an effort to simultaneously protect the metallic waterwall tubes while maintaining excellent heat transfer. One such refractory is known as a "monolithic" refractory. A monolithic refractory is produced by gunniting a ceramic material directly onto studded waterwall tubes. However, some monolithic refractories have been known to suffer from low thermal conductivity, low strength, and bonding difficulties which can lead to excessive slag accumulation hampering high thermal conductivity leading to poor efficiency.

Another type of commercial refractory is the "tube tile or block" design. FIG. 2 presents a conventional tube block design. Typically, the tube block is a square or rectangular refractory tile, (typically no more than 8–12 inches in height H by 8–12 inches in width W by 1 inch in depth D), modified on its back face with channels C and ridges R for fitting properly to the waterwall tube design. A refractory wall is built as these tube blocks are assembled in a manner similar to laying bricks, that is, a tube block is set in place, its periphery covered with mortar, and another block is set either atop or beside the first block. This building continues until the desired wall is constructed. The tube block and tube assembly are typically secured by adding a stud S to the membrane M or directly to the waterwall tube passing the stud through a hole H in a ridge R of the tube block, and tightening the stud S by a screw A. See FIG. 3. Typically, the channels of a tube block do not directly contact the metallic tubes they receive. Rather, the channel and tube are bonded together by a mortar interlayer (not shown). Although the mortar provides a good bond between the tubes and the tube block, its own thermal conductivity is poor and so it inhibits the flow of heat from the furnace to the tubes. In general, tube blocks provide the advantages of high strength, better bonding and a higher thermal conductivity than the monolithic designs.

When the conventional tube assembly comprises 3-inch diameter metallic tubes having centers spaced at 4 inch intervals, the single tube block typically has a height of about 7⅞ inches, a width of about 7⅞ inches, and a depth of 1 inch. This spacing provides an intimate fit between tube blocks (i.e., about ⅛ inch) which reduces the chances of developing an air gap that hinders heat flow between the tubes and the tube block assemblies.

One commercial refractory tube block is the design shown in FIG. 4. This design is similar to the conventional prior art design shown above, except for a groove around the periphery of the block. Although this design possesses the discussed advantages over monolithic barriers, it nonetheless has a depth of at least about 1 inch, and so provides poor heat flow and is heavy.

Another commercial tube block design is the ship-lap design. Originally utilized in circulating fluidized bed boilers, the ship-lap design, shown in FIG. 5, has an interlocking design which prevents small particles (such as sand) from infiltrating the gaps between adjacent tube blocks. However, the interlocking design makes manufacture of the ship-lap design very expensive. Moreover, the depth of a typical ship-lap block is at least about 0,875 inches. Although this generous depth provides insurance against cracks in the tube block, it also significantly inhibits heat flow through the refractory and makes for a very heavy block.

In an effort to improve the thermal conductivity of the tube block designs, U.S. Pat. No. 5,154,139 ("the Johnson patent"), assigned to the Norton Company, disclosed a tube block having a ½ inch depth with ribs in its channels. As shown in FIG. 6, when this ribbed tube block is placed against the tube assembly, the ribs contact the tube walls. This direct contact allows heat to bypass the low thermal conductivity mortar and so provides a higher thermal conductivity than the other conventional tube block designs. The slight (i.e., ½ inch) depth of this design also enhances its heat conductivity. However, commercial embodiments of the Johnson patent were found to fail in the field. In particular, cracks began to develop in the tube blocks at the point designated as "x" in FIG. 6.

Therefore, there is a need for a refractory tube block which is light and reliable, and has superior heat conductivity.

SUMMARY OF THE INVENTION

Referring now to FIG. 7, in accordance with the present invention, there is provided a waterwall heat transfer system comprising a tube block and an assembly, the assembly comprising a plurality of parallel tubes 91 connected therebetween by a membrane 92, wherein the tube block comprises:

a) a base section 1, and b) a plurality of spaced ridges 2 extending upward from the base section 1, the upper surface of at least one of the spaced ridges 2 defining a generally horizontal surface 3, the ridges being spaced to define channels 4 therebetween, the height of at least one of spaced ridges 2 being such that the membrane 92 of the assembly seats thereon, said tube block containing a means for securing the tube block to the assembly.

DETAILED DESCRIPTION OF THE INVENTION

Without wishing to be tied to a theory, it is believed that the failures of the commercial embodiments of the Johnson patent were due to the large concentrations of stress at the contact points between the tube block and the metallic tubes. By raising the central ridge of the tube block so that the membrane of the tube assembly seats on the central ridge (thus preventing direct contact between the tube block and metallic tubes), it has been unexpectedly found that the above failures do not occur even when the tube block has a depth as thin as 0.750 inches.

Figure 1:
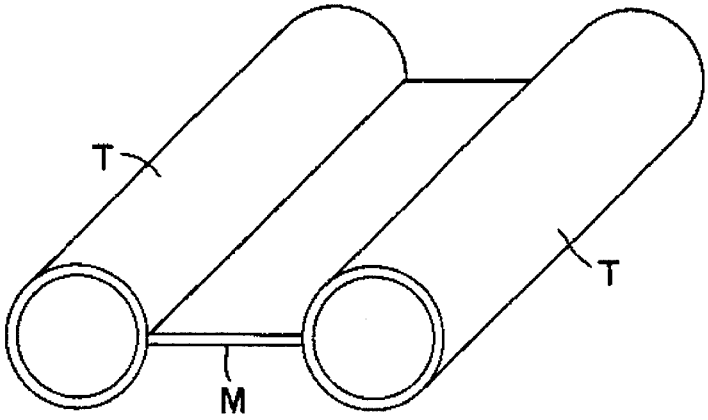
FIG. 1 PRIOR ART
FIG. 1 is a perspective view of a conventional tube assembly.
Figure 2:
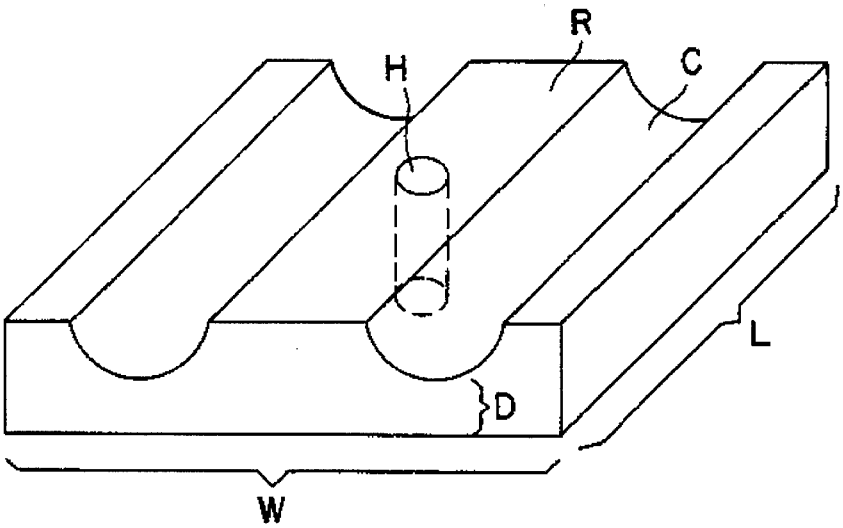
FIG. 2 PRIOR ART
FIG. 2 is a perspective view of the prior art generic tube block design.
Figure 3:
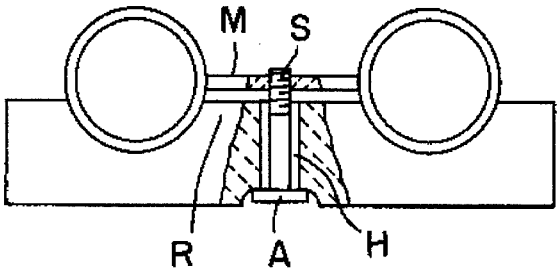
FIG. 3 PRIOR ART
FIG. 3 is a side view of a tube assembly secured to a conventional tube block.
Figure 4:
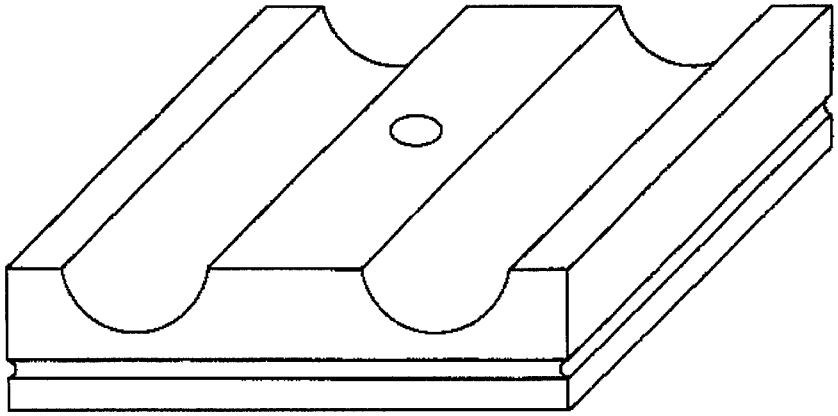
FIG. 4 PRIOR ART
FIG. 4 is a perspective view of a prior art design.
Figure 5:
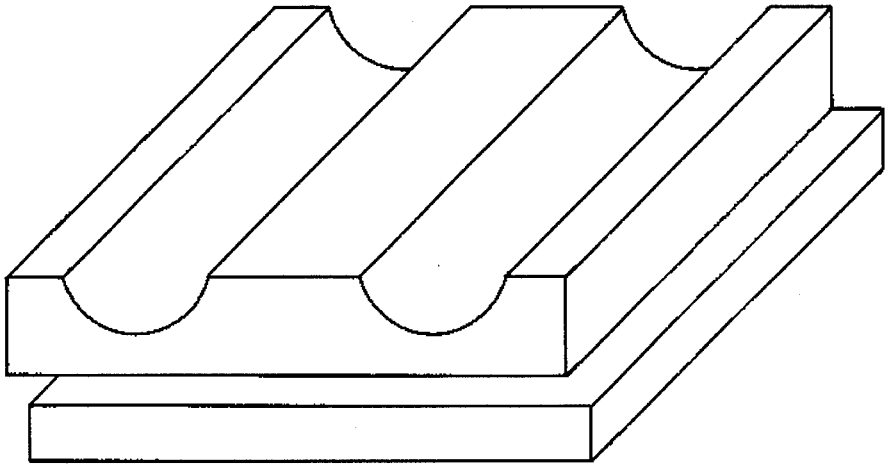
FIG. 5 PRIOR ART
FIG. 5 is a perspective view of the prior art ship-lap design.
Figure 6:
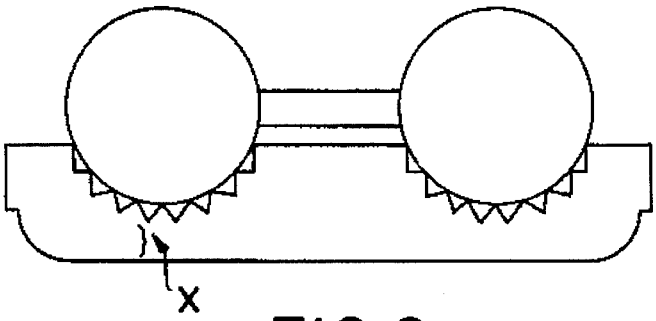
FIG. 6 PRIOR ART
FIG. 6 is a side view of the prior art Johnson patent design.
Figure 7:
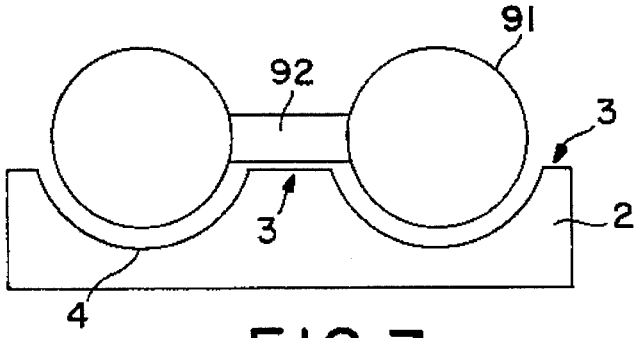
FIG. 7 is a side view of one embodiment of the present invention.
Figure 8:
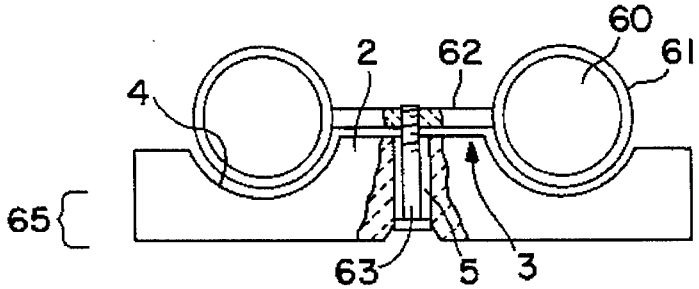
FIG. 8 is a cross-sectional view of one embodiment of the present invention secured to a tube assembly.

Referring now to FIG. 8, as the tube block 50 is placed against the tube assembly 60, the horizontal plane 3 of the central ridge 2 is secured to the membrane 62 of the tube assembly 60 by a passing the assembly's threaded stud 63 through the hole 5 provided therefor in the central ridge 2. Because the height of the central ridge 2 (defined as the distance from the horizontal plane 3 to the front face of the tube block) exceeds the sum of the depth of the tube block 50 and the radius of the tube 61, the tubes 61 cannot intimately contact the channels 4. Preferably, the gap between the tubes 61 and the channels 4 is between about ⅛ and ⅜ inches. As threaded stud 63 is tightened, the mortar-filled (not shown) channels 4 of the tube block 50 are forced against the tube assembly 60, thereby eliminating air spaces. The mortar acts to hold the tube block 50 in contact with the tube assembly 60, should the attachment means, i.e. threaded stud 63 and bolt, corrode during prolonged use.

Although the size of the tube block will vary depending upon the end use application and the tube size of the furnace with which it is being used, individual tube blocks generally have dimensions of from about 6" to 12" width, 6" to 12" height and 0.625 to 0.750 inch depth. However, in some embodiments servicing tube assemblies having 3 inch diameter tubes with centers spaced at 4 inch intervals, the front face of the tube block is only about 7¾ by 7¾ inches. Without wishing to be tied to a theory, it is believed the conventional 7⅞ by 7⅞ inch design produces a ⅛ inch gap between tube blocks which does not leave enough room for thermal expansion of the blocks and so is prone to premature cracking. It is believed the reduced dimensions of this embodiment (i.e., blocks which provide a ¼ inch gap therebetween) of the present invention will further relieve the stress upon the tube blocks. The depth 65 of the tube block 50 is typically between about 0.5 and 1.0 inches, preferably between about 0.5 and 0,750 inches. It is believed that this decreased depth provides for an approximate 33% gain in thermal conductivity over conventional 1 inch tube blocks. The decreased dimensions also decrease the weight of the tube block. In one embodiment in which a 7¾" by 7¾" by 0,750" tube block consists essentially of oxynitride or nitride-bonded silicon carbide, the weight of the tube block is only about 6.5 pounds.

In some embodiments having three spaced ridges, the central ridge extends farther than the lateral ridges. Typically, this extension is between 0.5 and 1.0 inches longer than the extension of the lateral ridges.

Due to the extremely high temperatures generated in the primary combustion zone (or first passage) in which the tube blocks are used, the tube block typically comprises silicon carbide, preferably an oxynitride, nitride-, or oxide-bonded silicon carbide. However, other suitable refractory materials such as alumina, zirconia, and carbon may be employed. In addition to the refractory material per se, the tube blocks will further contain a high thermal conductivity bonding system. A preferred tube block composition contains about 80 to about 95 parts silicon carbide, and about 5 to about 20 parts bonding agent such as a nitride or oxide based material. More preferably, the block will be made from any of CN-163, CN-183, CN-127 or CN-101, each of which is available from the Norton Company of Worcester, Mass., or comparable refractories.

Any conventional technique typically used in the manufacture of tubes blocks may be used to make the present invention. In preferred embodiments, a mixture comprising silicon carbide grain and binders is loaded into a dry press and pressed to form a green body, the green body is then dried and fired in a tunnel kiln having an oxygen or nitrogen atmosphere to produce a fired refractory.

The refractory mortar used with the present invention may be of any suitable composition and preferably of a composition which provides the highest thermal conductivity and heat transfer between the tube block and the waterwall tubes. Suitable mortar compositions are generally based upon silicon carbide and further contain a bonding agent that adheres strongly to the tube block and metal waterwall tubes. In preferred embodiments, the mortar contains copper metal and silicon carbide. More preferably, the mortar is MC-1015, a copper-containing mortar available from the Norton Company of Worcester, Mass.

Although not shown, additional tube blocks can be placed on adjacent portions of the tube assembly. Depending upon the size of the boiler, tube blocks will normally be placed above, below and on both sides of each other to cover most of the waterwall tubes in the primary combustion zone as required for protection. In a conventional MSW facility, these tube blocks would usually be used to cover all waterwall tubes subject to deterioration from the products of combustion.

Figure 9:
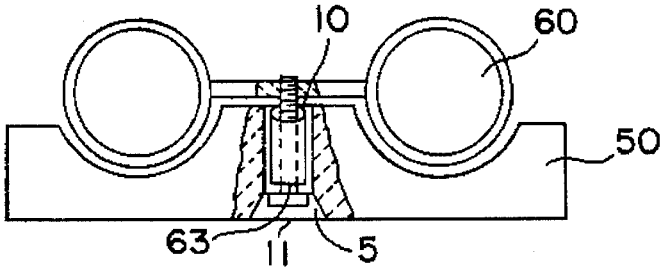
FIG. 9 is an embodiment of the present invention in which a collar is wrapped around the stud and a cap is placed upon the tube block hole accommodating the stud.

In some embodiments of the present invention, a ceramic collar 10 is wrapped around the stud 63 which secures the tube block 50 to the tube assembly 60, and a cap 11 is placed upon the hole 5 in the tube block which accommodates the stud 63. See FIG. 9. It is believed these modifications will keep the stud relatively cool, thereby retarding its corrosion.

Figure 10:
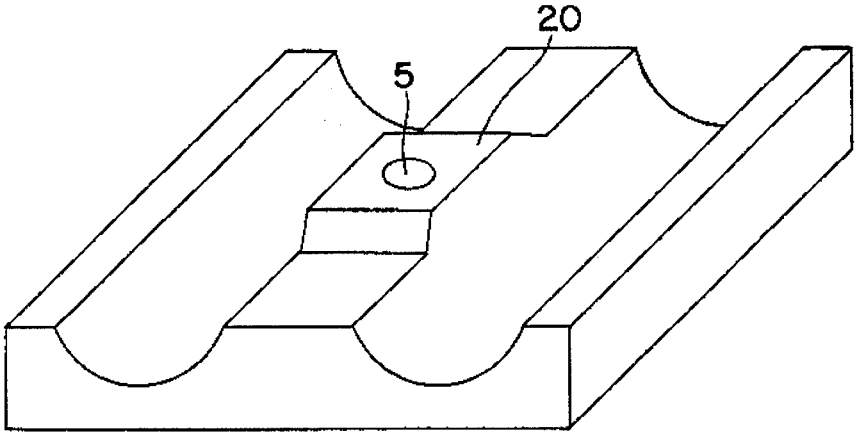
FIG. 10 is an embodiment of the present invention in which the central ridge does not run the length of the tube block.

In some embodiments, the extended ridges 20 of the tube block do not run the length of the block, but rather extend only in the vicinity of hole 5. See FIG. 10. It is believed that this design is helpful in reducing stress on blocks used in large furnaces, wherein thermal expansion of long tubes creates an axially uneven force upon the blocks. In certain embodiments, the ridges run less than about 50% of the length of the base section.

In some embodiments, a conventional tube block refractory system is modified by placing a refractory strip (typically about 0.5 by 6.5 by 0.625 inches) upon the horizontal plane of the central ridge of a conventional tube block. It has been found that this modification also produces the desired result of lifting the refractory tube block slightly off the surface of the waterwall tubes which minimizes high stresses caused by significant expansion of the waterwall tubes and enhances the integrity of the tube block system.

What is claimed is:

1. A water heat transfer system comprising a tube block and an assembly, comprising a plurality of parallel tubes connected therebetween by at least one membrane, wherein the tube block comprises: a) a base section, and b) a plurality of parallel, spaced ridges extending outward from the base section, the surface of at least one of the ridges defining a surface for receiving the membrane, the membrane being secured to the surface of the ridge, the ridges being spaced to define parallel channels therebetween, the extension of at least one of spaced ridges being such that the parallel tubes are free of contact from the channels, whereby large concentrations of stress between the parallel tubes and the channels are eliminated.

2. The waterwall heat transfer system of claim 1 wherein the ridges span the length of the base section.

3. The waterwall heat transfer system of claim 1 wherein the ridges run less than about 50% of the base section.

4. The water wall heat transfer system of claim 1 wherein the membrane is secured to the surface of the ridge by an axial stud extending from the membrane being inserted through a hole extending from the surface of the ridge through the tube block.

5. The waterwall heat transfer system of claim 4 further comprising a cap for covering the hole at the base section of the tube block.

6. The waterwall heat transfer system of claim 4 further comprising a ceramic collar wrapped around the stud.

7. The waterwall heat transfer system of claim 1 having a gap between said tubes and said channels of between about ⅛ and ⅜ inches.

8. The waterwall heat transfer system of claim 1 wherein the tube block has a depth of between about 0.625 and 0.750 inches.

9. The waterwall heat transfer system of claim 1 wherein the spaced ridge having the membrane secured thereto extends farther from the base section than the other spaced ridges.

10. The waterwall heat transfer system of claim 9 having a gap between the tubes and the channels of between about ⅛ and ⅜ inches.

11. A waterwall heat transfer system comprising the tube blocks of claim 1, said tube blocks being rectangular and assembled adjacent to each other separated by a gap, said gap being at least ¼ inch long.

* * * * *